United States Patent [19]

Griebeler

[11] Patent Number: 4,887,248

[45] Date of Patent: Dec. 12, 1989

[54] ELECTROSTATIC TRANSDUCER AND METHOD OF MAKING AND USING SAME

[75] Inventor: Elmer L. Griebeler, Streetsboro, Ohio

[73] Assignee: Cleveland Machine Controls, Inc., Cleveland, Ohio

[21] Appl. No.: 319,913

[22] Filed: Mar. 3, 1989

Related U.S. Application Data

[63] Continuation of Ser. No. 218,477, Jul. 7, 1988, abandoned, which is a continuation of Ser. No. 904,695, Sep. 8, 1986, abandoned.

[51] Int. Cl.[4] ..... H04R 19/00

[52] U.S. Cl. ..... 367/181; 367/99; 367/140; 310/309; 381/174; 148/DIG. 135; 29/25.42

[58] Field of Search ..... 29/25, 42, 569 R, 569 L, 29/572, 576 B, 578, 579, 580, 581, 582, 590, 591, 594, 595, 602 A; 73/570, 587, 724, 753; 148/DIG. 12, DIG. 135, DIG. 159; 310/309, 310; 367/99, 103, 140, 178, 181, 191; 381/113, 116, 174, 178, 190, 191, 205; 156/625, 901

[56] References Cited

U.S. PATENT DOCUMENTS

| | | | |
|---|---|---|---|
| 1,975,801 | 10/1934 | Rieber | 179/111 |
| 3,328,653 | 6/1967 | Wolf | 179/111 R |
| 3,559,292 | 2/1971 | Weissman | 33/169 |
| 3,604,802 | 8/1971 | Ohmori | 356/152 |
| 3,651,687 | 3/1972 | Dory | 73/67.8 R |
| 3,744,906 | 7/1973 | Sato et al. | 356/4 |
| 3,792,928 | 2/1974 | Poilleux | 356/4 |
| 4,041,446 | 8/1977 | Liebermann | 340/17 R |
| 4,081,626 | 3/1978 | Muggli et al. | 179/111 R |
| 4,133,100 | 1/1979 | Myhre | 29/610 SG |
| 4,246,449 | 1/1981 | Biber | 179/111 R |
| 4,262,399 | 4/1981 | Cady | 29/25.42 |
| 4,275,599 | 6/1981 | Kohlenberger | 356/32 |
| 4,311,881 | 1/1982 | Reynard | 179/111 R |
| 4,326,155 | 4/1982 | Griebeler | 318/576 |
| 4,413,635 | 11/1983 | Myer | 128/782 |
| 4,414,985 | 11/1983 | Myer | 128/782 |
| 4,459,526 | 7/1984 | Griebeler | 318/576 |
| 4,516,024 | 5/1985 | Hudson | 250/236 |
| 4,533,794 | 8/1985 | Beveridge | 179/111 R |
| 4,558,184 | 12/1985 | Busch-Vishniac et al. | 179/111 R |
| 4,695,986 | 9/1987 | Hossack | 367/140 B |

FOREIGN PATENT DOCUMENTS

| | | |
|---|---|---|
| 7802691 | 9/1979 | Netherlands . |

*Primary Examiner*—Brian S. Steinberger
*Attorney, Agent, or Firm*—Body, Vickers & Daniels

[57] ABSTRACT

An improvement in a capacitance type electrostatic transducer for transmitting and/or receiving pressure energy, wherein the transducer includes a relatively inflexible backplate with at least one major surface thereof formed of electrically conductive material, a relatively flexible membrane including a layer of electrically conductive material stretched across and coextensive with the one major surface of the backplate, electrically insulating means for maintaining a capacitor forming spacing between the major surface and the stretched membrane and wherein the major surface has protrusions extending through the spacing for supporting the membrane. The improvement is providing the protrusions as a multitude of discrete pedestals distributed over the major surface and formed by etching away the major surface except in photographically selected areas defining the pedestals. Each of the pedestals has a top surface covered by an individual thin piece of electrically insulating material remaining after a prior photographic developing process.

30 Claims, 10 Drawing Sheets

FIG. 3
(PRIOR ART)
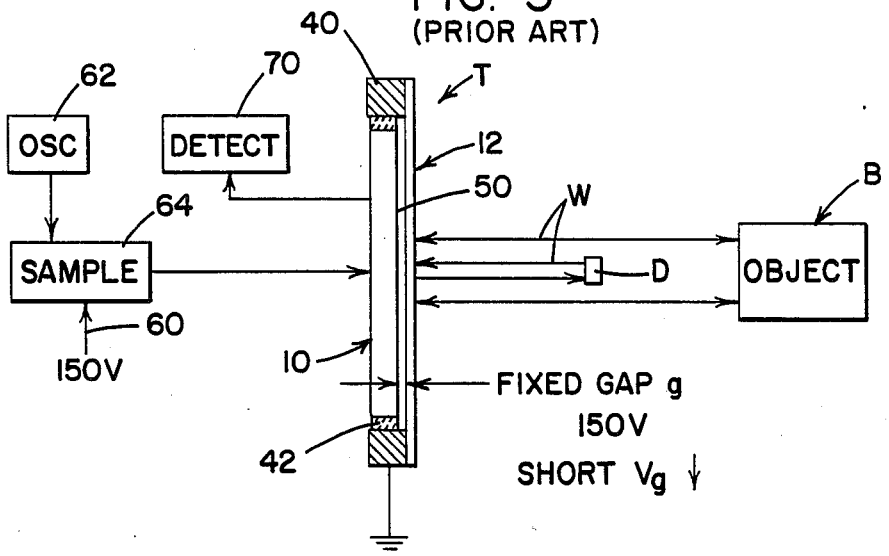
FIG. 3A
(PRIOR ART)
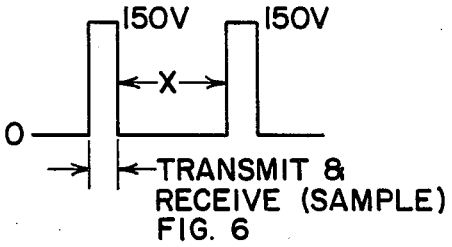
FIG. 4
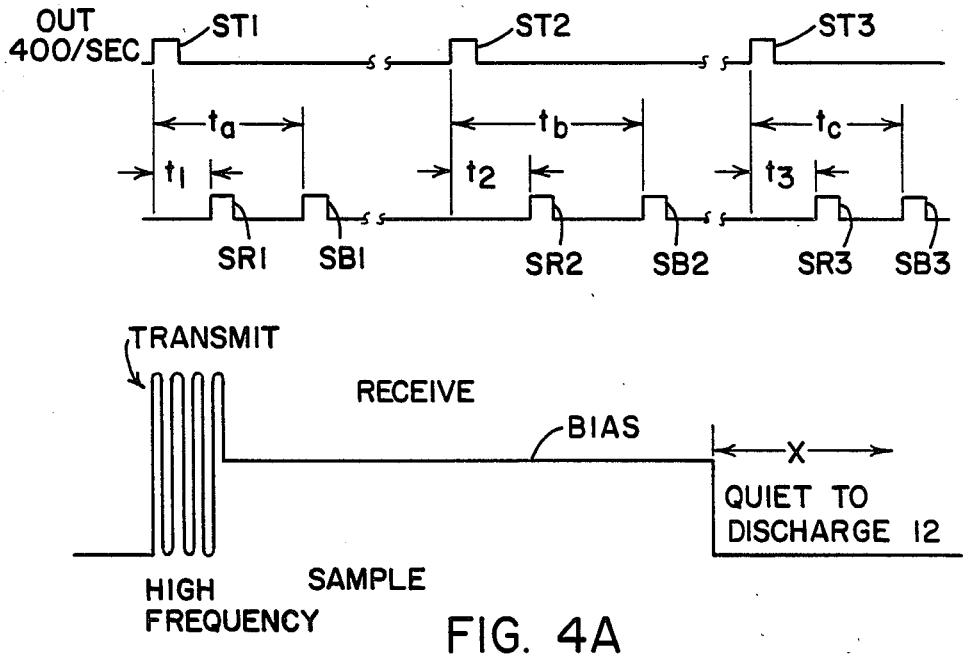
FIG. 4A
(PRIOR ART)

FIG. 5
(PRIOR ART)
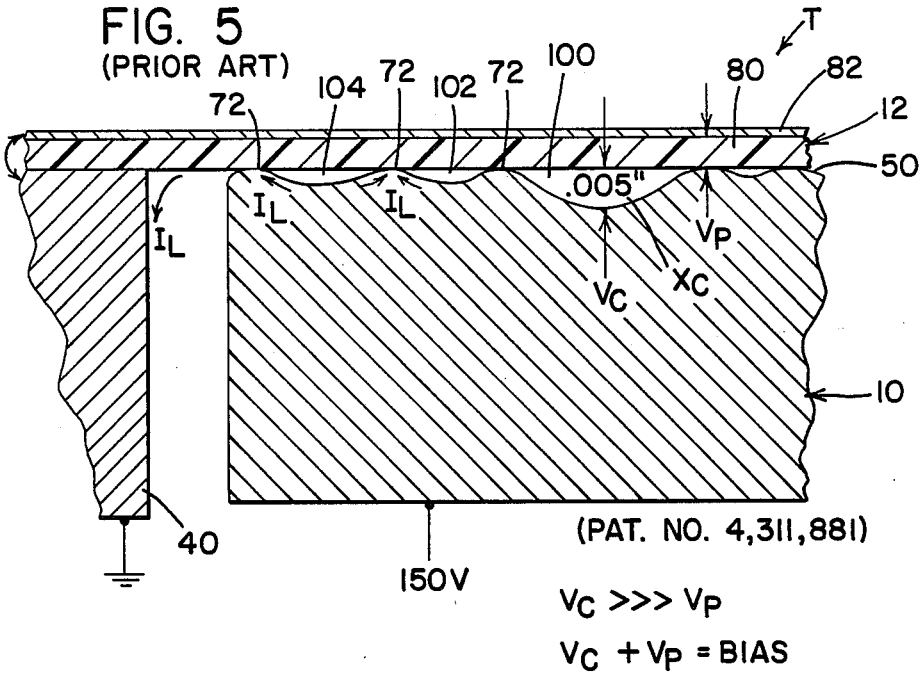
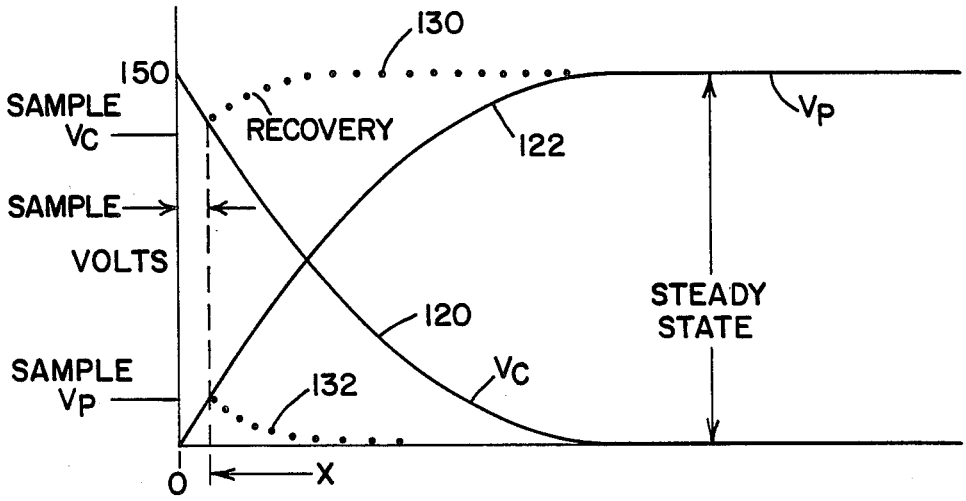
FIG. 6
(PRIOR ART)

FIG. 7
(PRIOR ART)
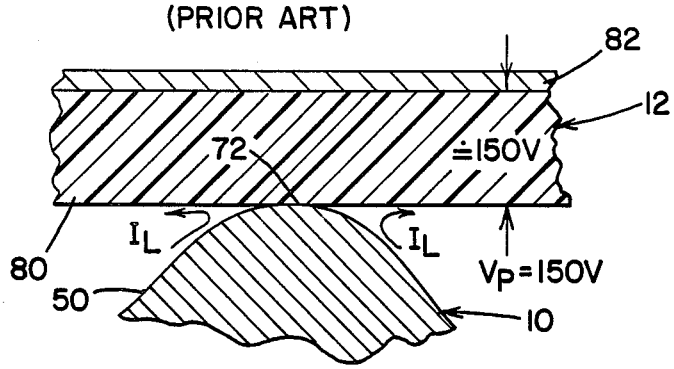
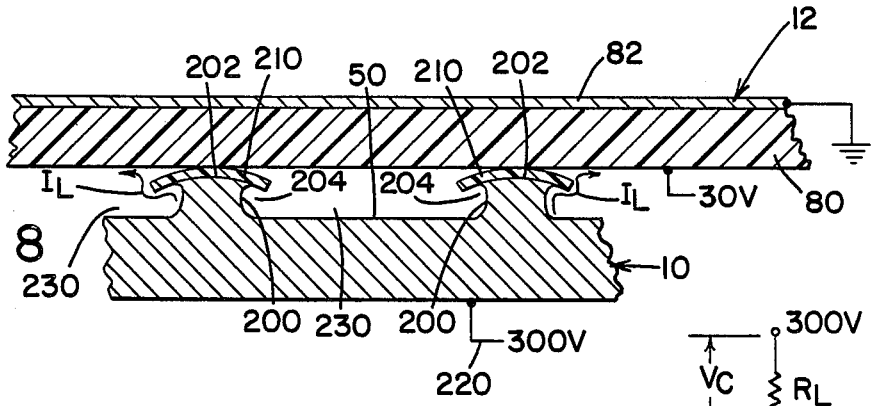
FIG. 8
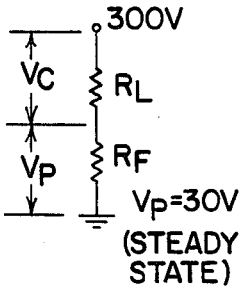
FIG. 8A
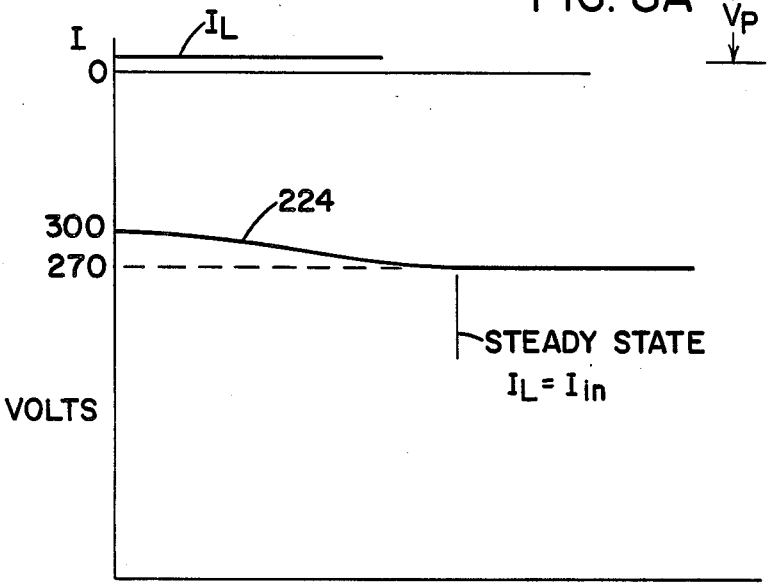
FIG. 9

ELECTROSTATIC TRANSDUCER AND METHOD OF MAKING AND USING SAME

This is a continuation of Ser. No. 218,477 filed July 7, 1988 which is in turn a continuation of Ser. No. 904,695 filed Sept. 8, 1986 both now abandoned.

The present invention relates to the art of capacitance type electrostatic transducers used for transmitting and/or receiving ultrasonic waves or shock waves and more particularly to an improved transducer of this type together with the method of making and using the new electrostatic transducer.

INCORPORATION BY REFERENCE

The present invention relates to an electrostatic transducer of the type which can transmit or receive shock waves for the purpose of determining the spatial relationship of a workpiece with respect to the transducer. Such a transducer is useful in robotic technology as disclosed in U.S. Pat. No. 4,459,526. This prior patent, which is incorporated by reference, describes the concept of using either a shock wave and ultrasonic wave to measure distance by using a probe to create a pressure wave and then receiving an echo as a return pressure wave after the created wave is reflected back to the probe. The time between the created pressure wave and echo can be electrically processed to produce a voltage signal indicative of the location of an object, such as a workpiece. This prior patent utilizes piezoelectric crystals for creating and receiving a shock wave, whereas the present invention relates to a capacitance type electrostatic transducer capable of transmitting and receiving a shock wave. Another shock wave processing system is illustrated in my prior patent, U.S. Pat. No. 4,326,155, which is also incorporated by reference as background information regarding the use to which the present invention can be adapted and the processing concept for determining location of a spaced object.

The present invention can be used for transmitting and receiving other pressure waves, such as ultrasonic waves. Several prior art patents showing transducers using ultrasonic waves for locating objects are incorporated by reference herein to explain problems encountered when using electrostatic transducers for measuring the position of an object from the transducer. These patents are U.S. Pat. Nos. 4,081,626; 4,246,449; and, 4,311,881.

As will be explained later, one aspect of the present invention employs a certain photographic process; therefore, U.S. Pat. Nos. 3,328,653 and 4,262,399 are incorporated by reference herein as background information.

BACKGROUND OF INVENTION

Electrostatic transducers have been produced for some time. These transducers generally involved a metallized plastic membrane stretched across a flat or curved surface of a conductive backplate. A gap between the membrane and the backplate is maintained to create a controlled capacitance. Tension on the membrane maintains the gap; however, humidity and other ambient conditions cause the membrane to elongate which, in turn, cause substantial problems in transmitting and/or receiving pressure energy waves. Some of these early transducers use metal membranes and depend totally upon the spacing of the membrane from the backplate for the capacitance needed to transmit waves by vibrating the membrane and receive echoes by the membrane being vibrated. Such prior systems with fixed gaps were not used extensively for detecting the position of objects due to low sensitivity, high voltage leakage and other problems. To correct some of the difficulties of these early electrostatic transducers, an electret type transducer was developed wherein the membrane was a plastic film covered by a metal, such as vacuum deposited gold. A chemical charge was applied to the film, which was held spaced from the major flat surface of the backplate. Such transducer was relatively inexpensive; however, the chemically created electric charge was relatively small so that the output of the electret transducer was and is very small. Further, the charge on the film dissipated, or was reduced, by atmospheric conditions. All of these difficulties caused electret transducers to be useful for only limited purposes. They were not adapted for the rigors of industrial applications requiring high precision location of objects. These prior electrostatic transducers required a relatively wide gap, which resulted in poor sensitivity and substantial difficulty in controlling response; therefore, such transducers could not be employed for controlling robotics or in other environments requiring repeated and accurate determination of the spatial relationship of an object from the transducer or a probe housing the transducer.

Capacitance type electrostatic transducers with all their disadvantages and limitations, both in repeatability and in production, were still considered to be the least expensive type of transducers for the purposes of sending and receiving ultrasonic waves for range finders. To rectify the many problems in this type of device, it was proposed to produce a plurality of grooves or other striations in the major surface of the backplate to provide several protrusions extending from the surface. These protrusions contact the plastic film portion of the membrane. In this manner, the limited areas of contact by the protrusions created several intermediate cavities that acted as a capacitor. The spacing under the membrane could be reduced substantially over prior transducer designs requiring a fixed gap between the backplate and membrane with no actual contact. This smaller spacing increased sensitivity.

With a biasing voltage applied across the metal surface of the membrane and the surface of the backplate, a burst of high frequency voltage across these members causes vibration of the membrane and thus a high frequency, or ultrasonic, wave to be transmitted from the transducer. By maintaining the biasing voltage, echoes received by the transducer from various objects could vibrate the membrane causing high frequency voltage fluctuations across the metal layer and backplate. In this manner, ultrasonic signals could be transmitted and the echoes could be received by transducers wherein the backplate had protrusions engaging the plastic film of the stretched membrane. This concept was a substantial improvement over prior electrostatic transducers for use in transmitting and receiving ultrasonic waves; however, there were substantial limitations as set forth in U.S. Pat. No. 4,081,626. The basic disadvantage of these transducers using grooves or striations to create the capacitance between points of contact with the membrane is caused by leakage voltage from the backplate to the plastic or insulating layer of the membrane. For this reason, the membrane becomes charged rapidly and biasing voltage appears across the membrane. Consequently, no voltage appears across the gaps created between the striations. The output of such a transducer decreases somewhat exponentially. This leakage current flow can also cause a breakdown of the film so that the membrane could be punctured. One way to solve this basic problem with prior transducers was provision of a power source having an increased available current. The leakage current was provided by more available current. Such high current operation was not desirable; therefore, the problem of charging the insulation portion of the membrane was reduced by providing less contact area between the backplate and membrane. This concept is discussed in U.S. Pat. No. 4,081,626 wherein the striations or grooves are provided with further surface roughening features to reduce contact area. The concept of reducing contact area is also taught in U.S. Pat. No. 4,246,449. In this patent, the protrusions are machined by the well known process of electrical discharge machining (EDM). Sand blasting, more grooving or EDM were all suggested as processing procedures for reducing the contact area between the backplate and the membrane; however, such manufacturing processes were not controllable and did not produce the desired sensitivity or consistency needed for electrostatic transducers to be used as a device for determining distances. Surface treatment of the ridges used to create capacitor cavities in the backplate would vary from transducer-to-transducer. This problem is recognized and attempted to be solved in U.S. Pat. No. 4,311,881.

The efforts to reduce the area of surface contact on ridges between the grooves on the backplate still allow substantial leakage current flow; therefore, the biasing voltage ultimately appeared across the membrane to reduce the effective time during which the transducer can be used. In view of this limitation, a burst of energy causing an ultrasonic wave had to be stopped rapidly so that an echo could be received without distortion from the outgoing ultrasonic wave. There was just not sufficient time to allow transmission of a wave and reception of an echo before the membrane was overly charged by leakage current. For that reason, the range of the transducer was substantially limited. Roughing of the backplate surface is not now and was not a solution to the basic leakage problem created by grooved type transducers, even though these transducers did correct deficiencies of earlier electrostatic transducers. The use of a grooved surface engaging the film of a membrane reduced the capacitor gap, but, caused current leakage problems and possible blow through or shorting of the membrane. These disadvantages of various transducer designs were somewhat counteracting and caused electrostatic transducers to be designed without actual total correction of any problem.

As so far described, transducers for the purpose of range finding have employed ultrasonic technology wherein the membrane is vibrated at a given frequency to create an ultrasonic pressure wave that progresses toward and is reflected from an object. These devices have not been operated by shock waves, as used with piezoelectric crystals in prior U.S. Pat. Nos. 4,326,115 and 4,459,526. Shock waves are more distinct and can be detected better than high frequency ultrasonic waves dependent upon vibration of the membrane of the transducer.

THE INVENTION

The disadvantages and limitations of electrostatic transducers used for depth and distance determination by transmitting and/or receiving pressure signals, such as ultrasonic waves and shock waves, are overcome by the present invention wherein the capacitance type, electrostatic transducer is produced in accordance with and has the construction of the present invention.

In accordance with one aspect of the invention, a transducer which includes a relatively inflexible backplate with at least one major surface thereof formed of electrically conductive material, a relatively flexible membrane including a layer of electrically conductive material stretched across and coextensive with the major surface, electrically insulating means for maintaining the capacitor forming spacing between the major surface and the stretched membrane, and where the major surface of the backplate has protrusions extending through the capacitance spacing for supporting the membrane is improved by forming the protrusions as a multitude of discrete pedestals created by etching away the major surface, except in photographically protected and selected areas. The unetched areas of the surface define the pedestals. In this manner, the pedestals have a precise shape and spacing controlled by an accurate photographic process. These pedestals support the membrane spaced from the backplate to create a capacitor action in a manner which provides uniformity and repeatability of operation without seriously affecting sensitivity or limiting the receiving time due to membrane charging.

In accordance with another aspect of the present invention, the protrusions on the major surface of the backplate, which are in the form of discrete pedestals, each include a top surface covered by an individual thin piece of electrically insulating material. In this manner, the current leakage path is increased in length which decreases the amount of leakage current and prevents rapid charging of the membrane. The biasing voltage needed for receiving pressure waves or echoes reflected from an identified object does not charge the membrane and the biasing voltage is retained across the capacitance gap of the transducer even though the backplate contacts the membrane. Thus, the available time of a receiving cycle can be increased to detect objects spaced at different distances from the transducer.

In accordance with still another aspect of the present invention, the pedestals are etched by a spray from the front and perpendicular to the backplate surface to undercut the pedestal from below the thin individual pieces of insulating material over the pedestals. This undercut further increases the leakage path necessary in transferring the biasing voltage from the capacitance cavities or gap to the membrane itself These improvements in the protrusions on the operating surface of the backplate are sufficient to decrease the leakage current so that a relatively low current source can maintain the biasing voltage across the capacitance gap with a minor amount of charging of the membrane.

In accordance with another aspect of the present invention, there is provided a method of producing the generally flat membrane supporting surface for the backplate of an electrostatic transducer of the type defined above. This method includes applying a photoresist coating on the supporting surface, masking from light a multitude of preselected, precisely dimensioned, small discrete areas in a preselected array distributed over the supporting surface, directing a sensitizing wave against the supporting surface to expose the unmasked areas of the supporting surface, developing the exposed areas of the supporting surface to remove the photoresist coating from the exposed areas whereby small pieces of the photoresist coating remain on the masked areas, etching the supporting surface with a solution reactive only with the supporting surface in the unmasked areas, and, then, continuing this spray etching until the small pieces of photoresist material each define a pedestal on the supporting surface at the masked areas. By this method, the pedestals can be produced with precise shapes and sizes to create the desired operation of the transducer, while maintaining a high leakage resistance so that the membrane does not become overly charged when biasing voltage is applied to the transducer. Further, the array of precise pedestals can be modified to produce different spacing between the pedestals in different areas so that the resonant frequencies of various portions of the membrane are different. In this fashion, the membrane is modified to reduce the tendency of the membrane to ring after energized during the application of voltage to produce a shock wave.

In accordance with still a further aspect of the invention, the transducer is operated by a shock wave, as opposed to a high frequency voltage signal necessary to create an ultrasonic wave. A biasing voltage can be applied to the transducer so that the application of the biasing voltage creates a shock wave. An echo from the shock wave is then detected by the biased transducer so that there is no need to create an alternating frequency burst of energy for operating the electrostatic transducer.

The primary object of the present invention is the provision of an electrostatic transducer of the type having a fixed backplate, a spaced membrane and a biasing voltage for receiving pressure signals, such as echoes, which transducer can operate without rapid charging of the membrane by the biasing voltage.

Still a further object of the present invention is the provision of an electrostatic transducer of the type defined above, which transducer can operate without an increased current demand and has an increased leakage current resistance between the backplate and spaced membrane.

Still a further object of the present invention is the provision of an electrostatic transducer of the type defined above, which transducer can be manufactured inexpensively, with consistent operating parameters from one transducer to another so that the transducer has generally fixed known operating characteristics.

Still a further object of the present invention is the provision of a transducer, as defined above, which transducer has high sensitivity with a low capacitance and small gap or spacing between the backplate and membrane.

Yet a further object of the present invention is the provision of a method of operating a transducer as defined above, which method includes creation of a shock wave by an abrupt application of a biasing voltage across the transducer, which shock wave can be reflected back as an echo to be received by the transducer.

Still a further object of the present invention is the provision of a transducer, as defined above, which transducer has a mechanically dampened membrane and can operate over a preselected biasing pulse having a time length predicated upon the desired operating characteristics of the transducer instead of charging time for the membrane. The window of biased operation can be extended to receive echoes from objects having diverse spacing.

These and other objects and advantages will become apparent from the following description taken together with the accompanying drawings which will be hereinafter described.

BRIEF DESCRIPTION OF DRAWINGS

FIG. 3 is a block diagram showing the prior art to explain the operation of electrostatic transducers used to measure the distance of objects;

FIG. 3A is a pulse diagram of the prior art, as shown in FIG. 3, illustrating transmitting and receiving aspects of the prior art;

FIG. 4 is a graph showing pulse transmissions and echoes illustrating the operating characteristics of the preferred embodiment of the present invention and also applicable to an explanation of the prior art;

FIG. 4A is a pulse graph showing operating characteristics of the prior art;

FIG. 5 is an enlarged, partially cross-sectional view illustrating aspects of the prior art to which the present invention is directed:

FIG. 6 is a voltage graph and leakage current graph illustrating certain operating characteristics of the prior art which are overcome by the present invention;

FIG. 7 is an enlarged cross-sectional view showing one of the disadvantages of the prior art, as shown in FIGS. 5 and 6;

FIG. 8 is a cross-sectional view of the preferred embodiment of the present invention;

FIG. 8A is a schematic diagram showing the equivalent circuit of the type of transducers employed in the present invention:

FIG. 9 is a graph showing operating characteristics of the preferred embodiment illustrated in FIG. 8 to show the distinction over the prior art illustrated in the graph of FIG. 6:

PREFERRED EMBODIMENT

Figure 1:
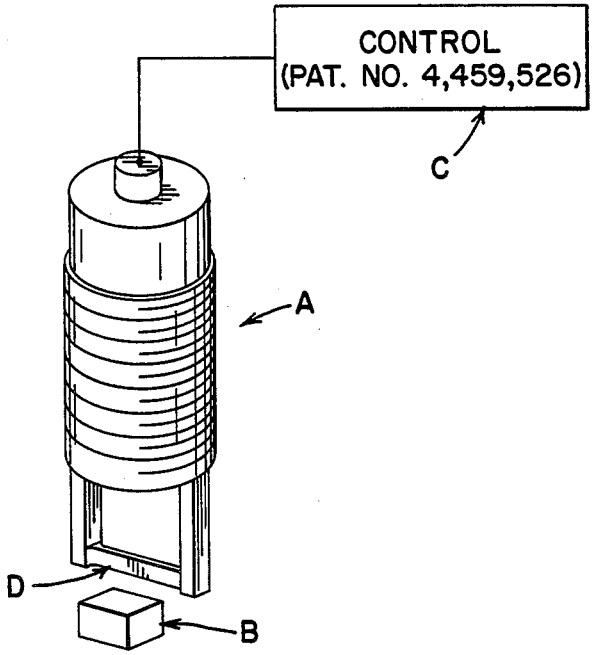
FIG. 1 is a pictorial view of a probe employing the preferred embodiment of the present invention.
Figure 2:
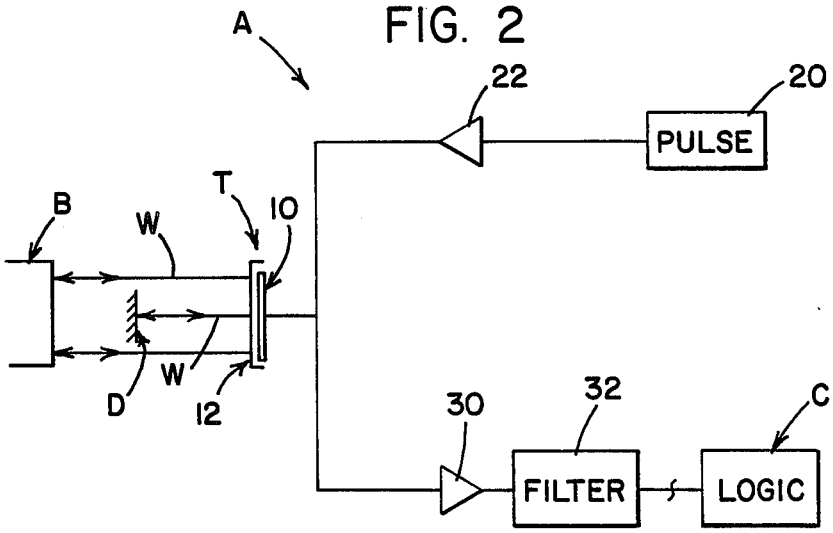
FIG. 2 is a wiring and schematic diagram showing operating characteristics of the preferred embodiment of the present invention.

Referring now to the drawings, wherein the showings are for the purpose of illustrating a preferred embodiment of the invention only and not for the purpose of limiting same, FIGS. 1 and 2 show a position detecting probe A for detecting the distance of an object B from the probe by utilizing known signal processing circuitry generally shown in prior U.S. Pat. No. 4,459,526. The electrical controls and circuitry do not form a part of the present invention and a variety of circuits could be employed for practicing the present invention. Fixedly positioned on probe A is a reference reflector D to provide a reflected signal or echo from an object with a known spacing. This signal is used to calibrate circuitry or control C for varying ambient conditions. The present invention relates to an improved electrostatic transducer of the capacitance type. Such a transducer is schematically illustrated as transducer T in FIG. 2. Transducer T is a circular structure having a generally inflexible backplate 10 and a flexible stretched membrane 12 spaced from the outer major surface of the backplate a distance which established a capacitance between the backplate having a conductive face or major surface and a membrane which is formed from a metal and is usually a metallized plastic sheet. In accordance with one aspect of the present invention, the transducer is operated in a shock wave mode wherein a pulse generator 20 applies a high voltage pulse through amplifier 22 and across backplate 10 and membrane 12 to cause rapid movement of or shock to membrane 12. This abrupt action creates a pressure shock wave W. Echoes return from reflector D and object B to membrane 12 which retains the high voltage of the pulse as a biasing voltage. Consequently, the echo of the shock wave W returns to the membrane and again rapidly moves or shocks the membrane. This received signal causes a voltage signal in the biasing voltage, which signal is increased by amplifier 30 and filtered by filter 32. The echo created signals are transmitted to a logic in control C which establishes a voltage output indicative of the spacing of object B from membrane 12. When the biasing voltage is applied across the transducer, a signal can be received therefore, the time of the biasing is an operating window or sample time for transducer T.

Membrane 12 is mounted within the body of probe A in a transverse direction facing reflector D. Shock waves have been employed for piezoelectric transmitters and receivers as illustrated in prior patents; however, shock wave operation has not heretofore been employed for capacitance type electrostatic transducers T for range finding. The advantage of employing this operating concept for transmitting and receiving shock waves or pressure waves is that a single voltage creates a detectable single signal or pressure wave and maintains the desired operating window; therefore, returning echoes are more discernible and identifiable and a single voltage source is required.

Operating characteristics of the prior art electrostatic transducers are illustrated in FIGS. 3, 4 and 4A. Backplate 10 is supported in a cylindrical ring 40 by a layer of ceramic 42 to produce a generally fixed gap g between the outer conductive major surface 50 of backplate 10 and the back of membrane 12. Gap g produces the capacitive reactance for transducer T which, in the prior art, has a voltage gradient of 150 volts D.C. supplied by an appropriate biasing source 60 applied across the transducer during transmission and reception by the transducer. An oscillator 62 having a high frequency output with a peak-to-peak of approximately 300 volts is applied across transducer T by an appropriate sample circuit 64. As illustrated in FIG. 4A, a D.C. pulse or sample duration is employed to create a window for operation of the prior art as well as for operation of the present invention for transmission and reception. To transmit an ultrasonic wave as in the prior art, not a shock wave, a bias voltage is applied across the transducer The membrane is then vibrated rapidly by the high voltage, high frequency output of oscillator 62. This burst of high frequency occurs at the start of the pulse or sample during which the biasing voltage is applied across the transducer. After the ultrasonic wave has been transmitted, the D.C. bias must be maintained across transducer T for receiving returned pressure waves from various objects in front of the membrane. Echoes returning from reflector D and object B vibrate membrane 12 in succession to change the gap g and, thus, induce a voltage signal which is detected by an appropriate detect circuit 70 and converted to a distance indicating voltage level. To transmit the next pressure wave W, the bias is removed so that member 12 can discharge for the next sample or window. Such discharge of the membrane is essential in the prior art so that the next sample or window starts with an uncharged membrane where the bias voltage is across gap g. This discharging time is especially critical in the improved transducer T of the grooved backplate surface shown in U.S. Pat. Nos. 4,081,626; 4,246,449; and, 4,311,881 schematically illustrated in FIG. 5. Each transmitted signal at the start of a sample time is followed by an echo for both the reflector and the object. This relationship of the return signals is schematically illustrated in FIG. 4 wherein transmitting signals ST are followed by a reflector echo SR and object echo SB. After a transmitted signal ST1, echo SR1 is detected in time $t_1$. This time is recognized and used to calibrate the detect circuit 70. Thereafter, in time $t_a$, the object echo SB1 is returned and detected. Calibrated detect circuit 70 then measures the time $t_a$ to determine the spacing of object B from membrane 12. Assuming that atmospheric conditions change, time $t_1$ ultimately shifts to time $t_2$, time $t_3$. In the preferred embodiment of the present invention, the transmit signal ST is a shock wave and is created 200–400 times per second. FIG. 4 is for the purpose of showing the calibration feature and the relationship between the transmitted signal and the two received echoes as employed in both the prior art and in the present invention. Of course, other echoes are received from various objects. They must be distinguished from the other echoes by standard circuitry of control C.

As explained in connection with the schematic representation of FIG. 3, there must be a gap g to create a capacitor between the membrane and backplate; however, this gap must be relatively small for high sensitivity. In this more basic representation, gap g cannot be controlled accurately and still be small; therefore, as illustrated in certain prior art, major surface 50 of backplate 10 is pressed against or held against the stretched membrane and is provided with a plurality of grooves which allow a plurality of contact points or ridges 72 across the major surface. Between the ridges or contact points, a plurality of cavities 100, 102, 104 have a depth creating capacitive reaction $X_C$. The depth or spacing is about 0.005 inches so that the capacitive reactance is relatively small for increased sensitivity. In practice, the grooves are not uniform since they are machined or pressed into the surface; thus, the gaps or spacing may vary to change the capacitive reactance.

When the biasing voltage used to receive pressure waves in the prior art, 150 volts D.C. is applied between the conductive portion of backplate 10 and the conductive portion of membrane 12, a voltage $V_C$ is created across cavities 100, 102, and 104. In most instances, stretched membrane 12 includes a plastic film 80 with a metallized outer surface 82 formed from a chemically stable metal, such as gold. Transducer T is biased by 150 volts D.C. in the prior art. Consequently, the voltage drop from the backplate to the membrane metallized surface is 150 volts D.C. to convert pressure waves to a voltage signal. Plastic film 80 is a dielectric, as is air in cavities 100, 102, 104; therefore, voltage across the film itself is increased by gradual charging of the film. This charging effect takes place through leakage current at the many contact points or ridges 72 between the grooves on surface 50. These ridges form protrusions on surface 50 and are used to control the spacing used to create a capacitor behind membrane 12. The areas of contact are to be minimized as suggested in the prior art to decrease leakage current flow. When reduction in the contact areas is excessive or nonuniform, the protrusions tend to localize current flow at the small contact points and also exert high pressures at these small contact points. Rupture of plastic layer or film 80 and destruction of the transducer can occur. Leakage current identified as $I_L$ is determined by the resistance of film 80 to current flow bleeding through ring 40. Such current is in the low nanosecond range and is supplied by voltage source 60. In the prior art this leakage current is substantially high compared to the rate of bleeding at ring 40, thus causing a generally total transfer of biasing voltage from voltage $V_C$ across the capacitor gap to voltage $V_P$ across the plastic film. Consequently, the bias voltage ultimately appears across film 80 and voltage $V_P$ approaches the biasing voltage. As this occurs, there is less voltage across cavities 100, 102, and 104 and the transducer will ultimately cease to function as a receiver for ultrasonic waves or, in accordance with the present invention, shock waves. With the resistance of the leakage paths relatively low due to direct contact between film 80 and ridges 72, membrane 12 becomes charged very rapidly. This is schematically represented in the graph of FIG. 6, wherein line 120 represents the average voltage across capacitor forming cavities 100, 10 104. Line 122 is the voltage $V_P$ across film 80. At time 0, a sample or window is created, as shown in FIGS. 3A, 4A by applying 150 volts D.C. between the metallized surface 82 of film 80 and surface 50 of backplate 10. Leakage current $I_l$ is relatively high; therefore, film 80 charges rapidly along line 122. Since the sum of $V_C$ and $V_P$ is the biasing voltage of 150 volts, as $V_P$ increases, $V_C$ decreases accordingly. Within a relatively short time, the membrane is charged and there is no appreciable voltage across the capacitor cavities 100, 102 and 104. Transducer T cannot effectively receive in this "steady state" condition. For that reason, the sample time or window has a duration short enough that $V_C$ remains substantially higher than $V_P$ to allow reception of a reflected wave or echo. In the prior art, after a sample, the probe had to rest in area X for a long time. Continued operation resulted in failure in a short time. After the sample time, voltage $V_P$ shifts to zero by discharging the film as shown by line 132. In like manner, the availability of voltage across the capacitor cavities 100, 102 and 104 recovers according to line 130. Since recovery occurs when the membrane is discharged as the biasing voltage is removed, the recovery curve 130 indicates $V_C$ as the biasing voltage available during the next sample. After recovery has taken place, a new sample can be taken by applying the biasing voltage and creating a high frequency pressure wave by oscillator 62. This leakage current problem of the prior art presents a serious limitation. The biasing voltage cannot remain across the transducer very long before steady state conditions exist. Consequently, the initial high frequency burst must be short. Still the receiving portion of the sample or window, shown as a straight line in FIG. 4A, can remain after the burst and dampening of the membrane only a short time to pick up echoes. In the prior art, a long quiescent time X is needed to prevent ultimate charging of the film due to leakage current charging of the membrane. Thus, only infrequent samples are possible. The prior art solution was to reduce areas on contact and/or provide short initial bursts with the disadvantage discussed earlier. Each burst causes a charging of the film. Prior transducers had to rest for long times to prevent failure by accumulative voltage build up.

The preferred embodiment of the present invention is illustrated in FIG. 8 wherein major surface 50 of backplate 10 is provided with a multitude of widely spaced, relatively small pedestals 200 having circular cross-sections, top surfaces 202 and annular undercut portions 204. A small circular piece of plastic 210 is fixed upon and covers the top surface 202 of each pedestal 200 to produce an outer protruding peripheral edge which substantially increases the length of the leakage current paths $I_L$ schematically illustrated as the arrows in FIG. 8. These upper plastic pieces substantially increase the leakage resistance between backplate 10 and film 80 and also protect against high pressure between the pedestals and the undersurface of the film. Consequently, puncture or blow through is less likely when high voltage is applied between film 80 and backplate 10. By increasing the length of the leakage path by the thickness of plastic piece 210 and by the outwardly extending peripheral edges of the plastic pieces, the leakage current can be and is substantially reduced so that the ability to bleed current to ring 40 predominates over leakage current $I_L$ and prevents charge up of film 80. FIG. 8A illustrates this, where $R_F$ is bleeding resistance to ring 40 and $R_L$ is leakage resistance.

Figure 19:
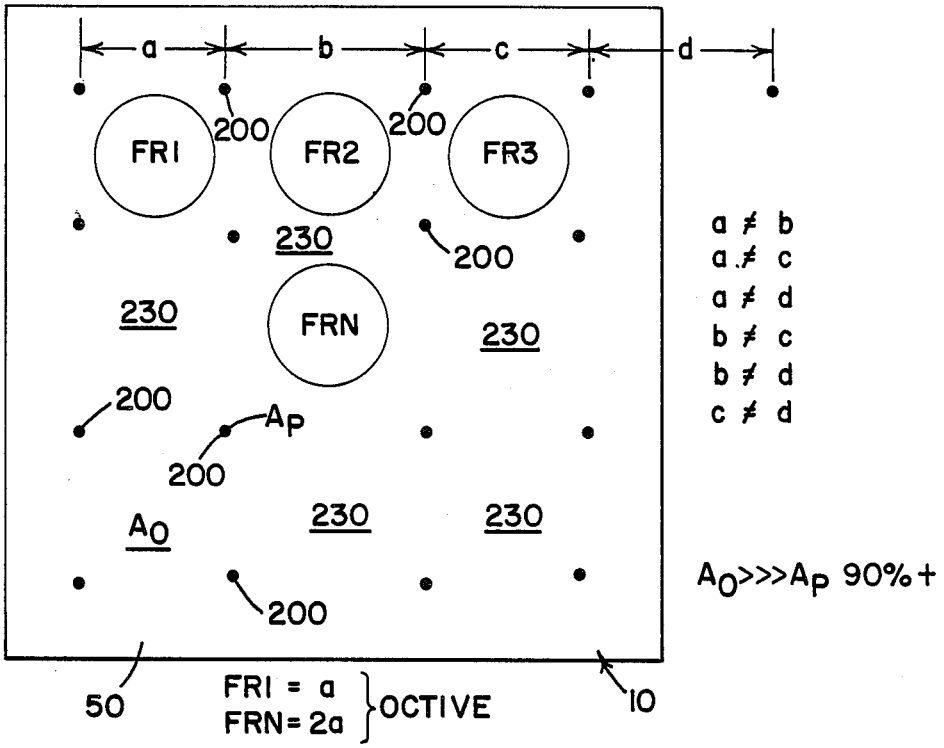

As will be explained later, and as alluded to with respect to FIG. 2, operation of transducer T in accordance with one aspect of the invention, is by creation of a single shock wave instead of a standard driven high frequency ultrasonic wave. When using the shock wave, a biasing voltage is applied across metallized surface 82 and surface 50 by an appropriate current source 220. In practice of the invention, the biasing voltage is 300 volts D.C.: however, a smaller biasing voltage could be employed without departing from the intended spirit and scope of the present invention. Referring now to FIG. 9, since the leakage current is relatively low, due to the increased leakage resistance of the unique shape of pedestals 200 and the upper plastic insulating pieces 210, layer 80 is discharged extensively between signals and cannot charge very high. In practice about 30 volts since the bleeding rate is about ten times the rate of current from leakage, i.e. $R_F$ is substantially greater than $R_L$ in FIG. 8A. For that reason, the 300 volts of biasing voltage applied across the transducer ultimately reaches a steady state condition as indicated by line 224 in FIG. 9. In practice, the leakage current is reduced to allow a build up of only about 30 volts across film 80, i.e. the $V_P$ voltage even during continuous operation. The remainder of the biasing voltage, (270 volts) appears across the capacitor cavities 230 on surface 50 and is the $V_C$ voltage. Pedestals 200 are protrusions in surface 50 for supporting film 80 in spaced relationship with the lower surface defining the bottom cavities 230. These capacitor forming cavities are really open areas which are interconnected in a field or array of spaced pedestals 200 as shown in FIG. 19.

Figure 9A:
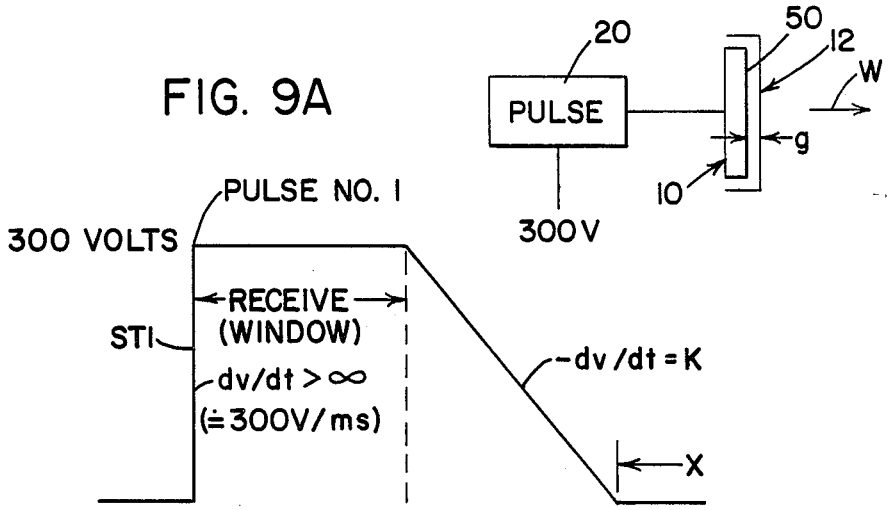
FIGS. 9A and 9B are graphs of operating characteristics employing shock waves with the preferred embodiment of the present invention shown in FIG. 8.
Figure 9B:
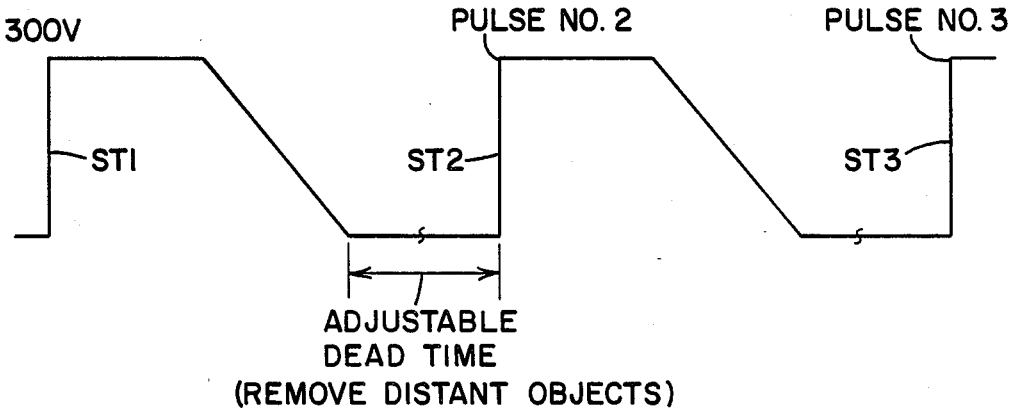

By preventing voltage across the film, the sampling time for creation of the pulses ST, as shown in FIGS. 4 and 4A, is not dependent upon the time when film 80 becomes charged to create the total biasing voltage across the film. The sample time can be as long as necessary with the steady state as shown in FIG. 9. In practice, 200–400 cycle times are created per second and each of them has a substantial rest period X between them. This concept is schematically illustrated in FIGS. 9A, 9B. Pulse generator 20 applies a high D.C. voltage across gap g, which gap is the capacitor forming spacing of cavities 230, shown in FIG. 8. The applied voltage, in practice, is 300 volts D.C. and is applied at a rapid rate indicated by the nearly vertical dv/dt in FIG. 9A. This rapid application of a voltage across gap g causes membrane 12 to create a rapid shock wave W. This shock wave is represented as pulse ST in FIG. 4. The high voltage is retained across gap g to produce a receiving window indicated in FIG. 9A. During this window or time, echoes from the reflector and object are received by membrane 12. This causes vibration of the membrane to generate voltage variations or signals so that the echoes can be detected in accordance with standard sonic processing practice To prevent a second shock wave as the high biasing voltage is removed, the voltage across the transducer is decreased along a straight line having a −dv/dt slope K. This removal of voltage closes the receiving window and is the beginning of the rest period X. Slope K is selected to preclude creation of a reverse or decaying shock wave. The dead time or rest period X is adjustable so that echoes from distant stray or background objects appear during this time when the transducer is not biased. Consequently, stray echoes are not sensed by the circuitry connected to the transducer. Thereafter, within 1/200–1/400 of a second, another pulse is created to generate the shock wave. This is indicated to be pulse No. 2. These pulses are continued at the rate of 200–400 per second with the desired adjustable dead time. Transducer T is used in industrial applications and the window is generally 1–2 ms. In this application the distance data is continuously updated. The present invention can have a duty cycle of 5%–80% where the prior art can not operate without a duty cycle of less than 5% and then for only short life spans. In addition, the biasing or receiving time can be adjusted for the parameters of the job being performed and are not predicated upon the decaying voltage available for detecting echoes received by the transducer.

As mentioned before, the prior art transducers using the electrostatic concept could operate for only short times. This is of no substantial concern in a camera range finder. The bias could be applied for 8–100 ms with a short burst of high frequency voltage at the start of the window. Only a single reading is needed and the transducer can discharge over a time of several minutes or more. If these prior electrostatic transducers were used industrially, they would either have a very slow response with a rest X of over one minute or they would fail in a matter of less than one hour. By using the present invention, a duty cycle of over about 5% (i.e. 1 ms window, 20 ms rest time) to 80% (i.e. 1 ms window, 0.25 ms rest time) with continous operation can be sustained for several days, if not longer. This type operation is needed for industrial applications, such as testing and robotics, and is not available in transducers of the prior art developed primarily for use in single shot camera range finders.

Figure 10:
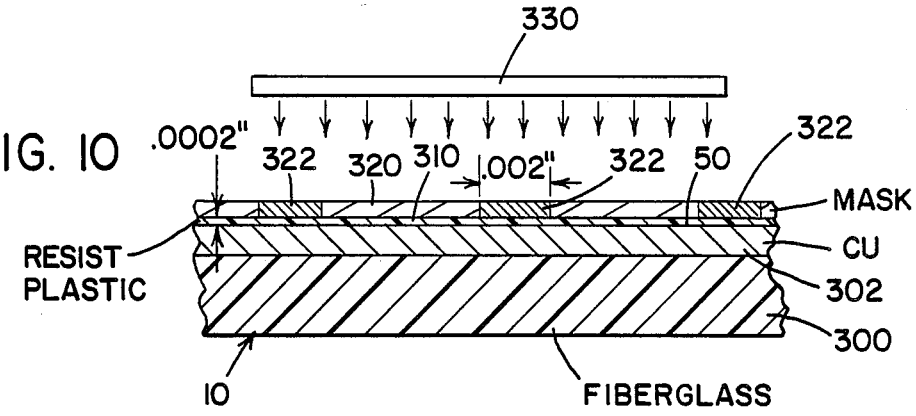
FIGS. 10, 11, 12, 13A, 13B and 13C illustrate the method of producing the preferred embodiment of the present invention as illustrated in FIG. 8 and show the steps of the inventive method utilized in conjunction with the preferred embodiment of the invention.
Figure 13A:
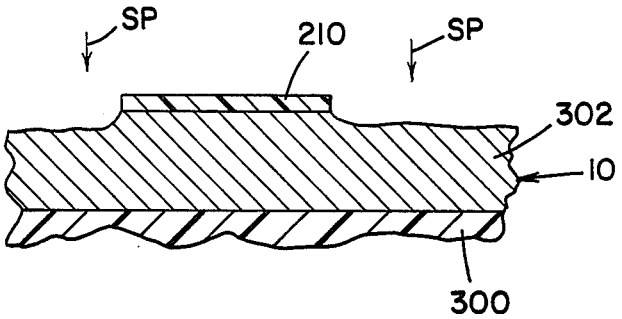
Figure 13B:
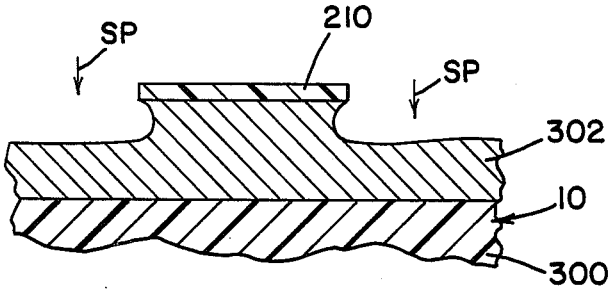

The preferred embodiment of the present invention is illustrated in FIG. 8. Operation of the new transducer in accordance with the new method using shock waves is illustrated in FIGS. 9A, 9B. To produce uniformly distributed pedestals 200, with controlled upper plastic insulating pieces, upper surface 50 is processed in accordance with the method schematically illustrated in FIGS. 10, 11, 12, 13A, 13B, and 13C. Backplate 10 is a circular disk cut from somewhat standard PC board material having a lower layer 300 of fiberglass and an upper copper layer 302. The upper surface of the copper layer is the major surface 50 of backplate 10. A disk-like blank of PC board material has a somewhat standard photoresist plastic material dipped, or rolled on, to form layer 310, which layer is electrically insulating. Photoresist material is well known and is available on the market from a company such as Kodak. It has been found that rolling of photoresist layer 310 onto surface 50 is the most successful, since this produces a very thin layer of photoresist plastic over the top of surface 50. An appropriate mask 320 has circular shaped areas 322 distributed in accordance with a selected array pattern. The diameter of these shaded areas is approximately 0.002 inches and the thickness of the coating or layer 310 is approximately 0.0002 inches. Mask 320 is positioned over layer 310, as shown in FIG. 10. A light source 330, which may be a standard source or an ultraviolet source, is then used to expose photoresist plastic layer 310 in the areas between shaded portions or areas 322 of mask 320. Thereafter, standard photodevelopment removes the photoresist material, except in those surface portions protected and shaded by areas 322 of the mask. The remaining plastic pieces 210 are circular and are the thin pieces ultimately defining the tops of pedestals 200. These pedestals are formed by an etching procedure schematically illustrated in FIGS. 13A, 13B and 13C. An appropriate etching solution, such as ammonium sulfate, is sprayed against copper layer 302. This layer is etched away progressively until the copper is undercut at 204, most accurately shown in FIG. 13C. The depth of etching and the undercut dimensions are a function of time, (f)t. The processing time is sufficiently long to cause the undercutting and contouring as specifically shown in FIG. 13C and schematically illustrated in FIG. 8. Spraying during etching is in a direction orthogonal to surface 50 and is indicated schematically as arrows SP in FIGS. 13A–13B.

By employing the present method., a transducer can be produced which retains a low charge on film 80 by reducing the contact area between the projections on surface 50 and film 80 of membrane 12. This produces the advantages which have heretofore been explained in detail; however, the pieces 210 and the controlled shape of the pedestals prevent sharp contact areas to cause high current and/or undue pressure against the film.

Figure 14A:
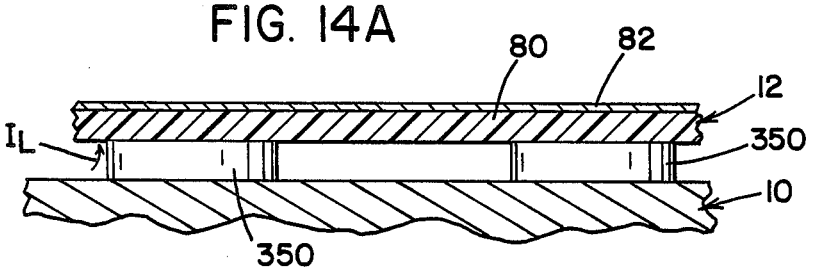
FIGS. 14A, 14B, 15, 16, 16A, 16B and 16C are partial views illustrating modifications of the preferred embodiment of the present invention.
Figure 14B:
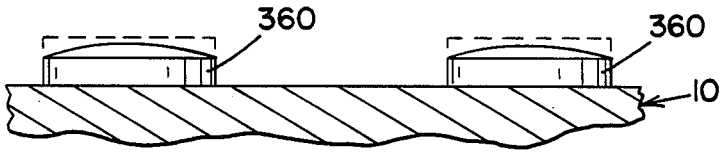
Figure 15:
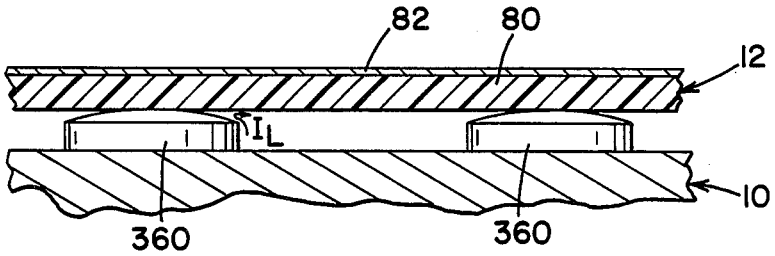

Referring now to FIG. 14A, a modification of the preferred embodiment is illustrated wherein pedestals 350 are produced by the etching process so far described with the upper plastic layer 210 removed. This view illustrates the use of the present method to produce an improved transducer having limited mechanical contact and an evenly distributed array of photographically produced pedestals; however, the advantages of employing the overlapping plastic pieces 210 are not accomplished. Another modification is illustrated in FIG. 14B wherein pedestals, such as pedestal 350 of FIG. 14A, are modified by a crowning action on the top which can be done by etching to produce evenly distributed pedestals 360. This feature produces a still further reduced contacting area with film 80, thus decreasing the amount of leakage current by increasing the leakage resistance. This is illustrated in FIG. 15 with a membrane 12 in position over backplate 10. These modifications of the pedestals are not the preferred embodiments and do not produce the tremendously satisfactory results experienced by employing the plastic pieces 210 on the top of pedestals 200, as previously described.

Figure 13C:
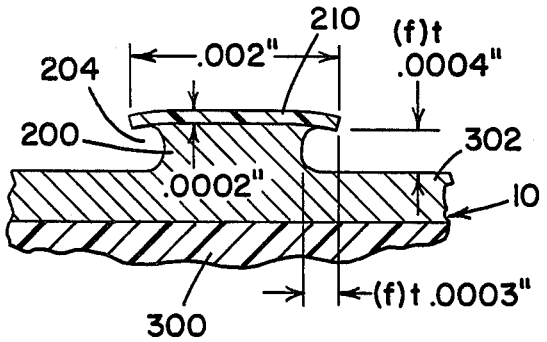
Figure 16:
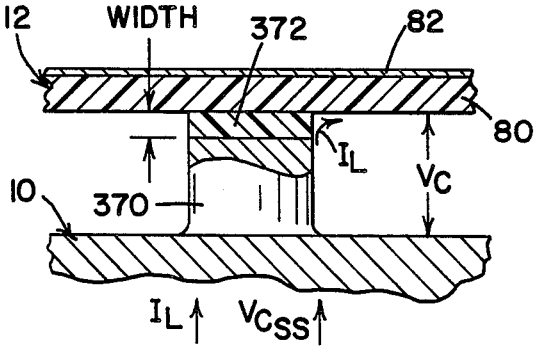
Figure 16A:
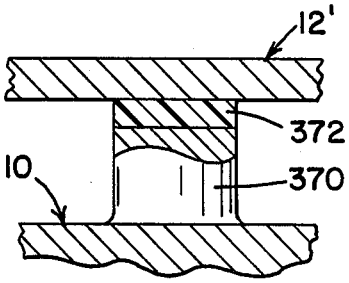
Figure 16B:
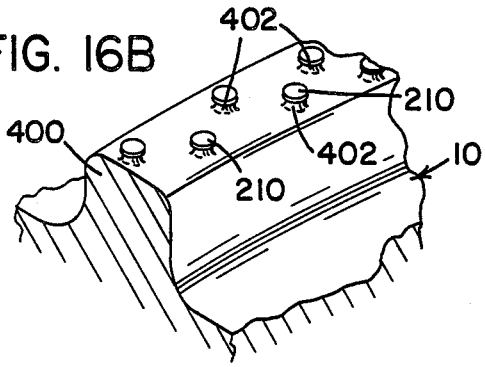

Referring now to FIG. 16, pedestals 370 are produced in accordance with the present invention, without an undercutting so that the upper layer 372 increases the length of the leakage path as indicated by the arrow in FIG. 16. By increasing the width of photoresist layer 372 the modification shown in FIG. 16 can be somewhat improved. A further modification of the system illustrated in FIG. 16 is shown in FIG. 16A wherein membrane 12' is a metal membrane and the photoresist plastic pieces 372 produce the insulation between the two metal layers forming the transducer. Still a further modification of the present invention is illustrated in FIG. 16B wherein a standard grooved backplate, as shown in the prior art, is provided with pedestals 402 on surface 400 in accordance with the method of the present invention and having upper plastic pieces 210, such as shown in FIGS. 8 and 13C.

Figure 11:
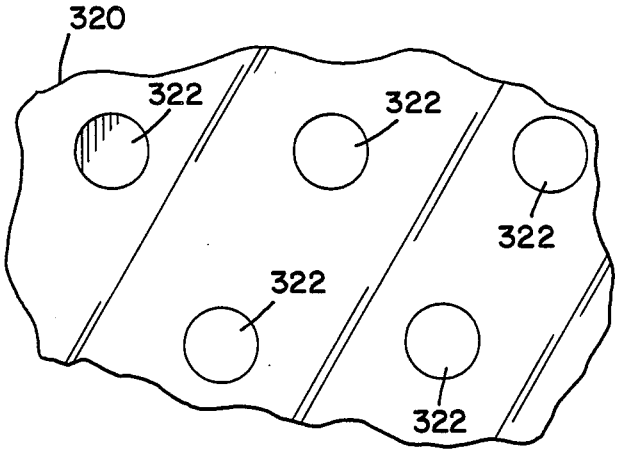
Figure 11A:
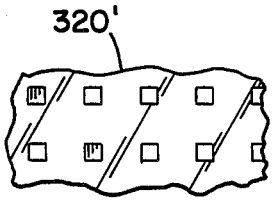
FIG. 11A is a modification of FIG. 11 showing that the pedestals can have many shapes and do not require a circular configuration as employed in the preferred embodiment shown in FIG. 11.
Figure 12:
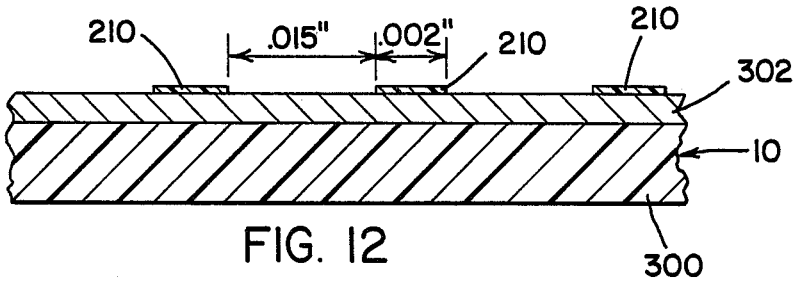
Figure 16C:
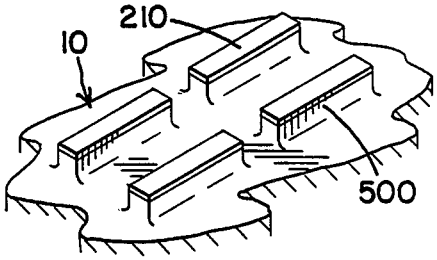

There is no requirement that the pedestals be circular in cross-section. They could be square as shown by mask 320' in FIG. 11A. The pedestals could be elongated and arranged in various patterns, as pedestals 500 in FIG. 16C. Other modifications in the configuration of the pedestals could be used without departing from the intended spirit and scope of the present invention, as set forth in the method of making the pedestals and the operation of the pedestals as discussed in connection with FIGS. 8 and 13C.

Figure 17:
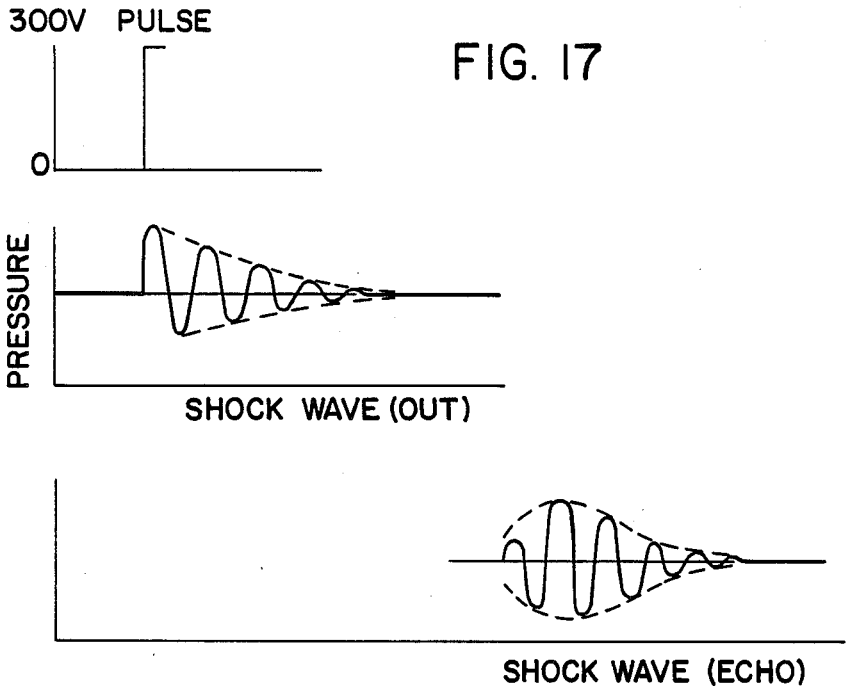
FIG. 17 shows three graphs of the electrical pulse, shock waves and return echo when using an electrostatic transducer in accordance with one aspect of the present invention.
Figure 18:
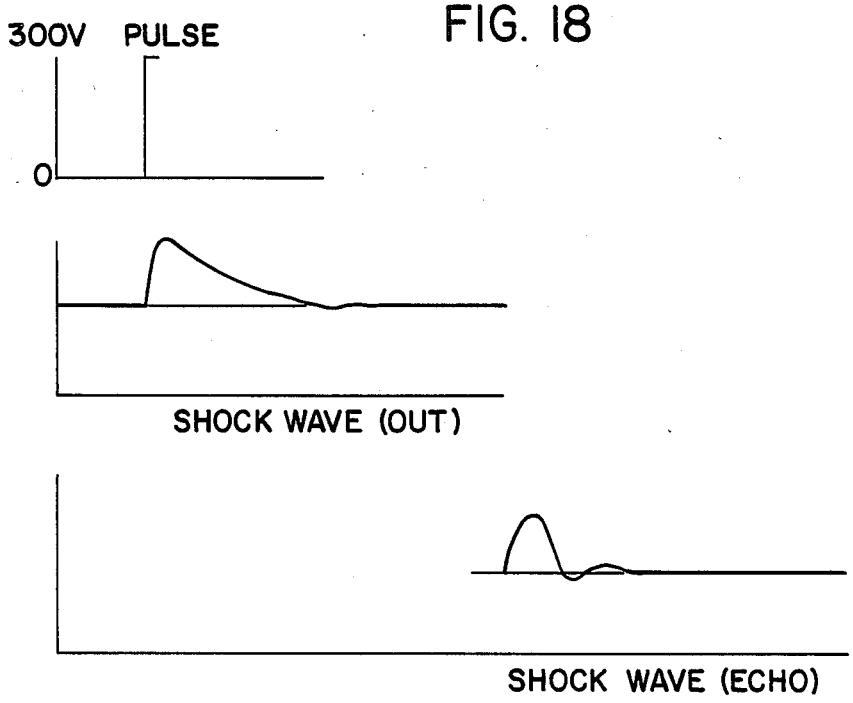
FIG. 18 shows three graphs as depicted in FIG. 17 using the aspect of the invention illustrated in FIG. 19: and, FIG. 19 is a chart of a portion of the array of pedestals employed in accordance with another aspect of the present invention.

FIG. 17 shows the rapid voltage pulse which creates a shock wave output from membrane 12. This acoustical pressure wave is a generally oscillating shock wave as shown in the center graph. The return shock wave or echo is an undulating pressure wave, indicated in the lower graph of FIG. 17. The time necessary for the shock wave to disappear or dissipate after being created and the length of the shock wave echo coming back is determined by the resonant frequency characteristics of membrane 12 when it is excited by the abrupt application of a D.C. voltage and then by the returning echo. To minimize the resonant characteristics of the membrane, as shown in FIG. 18, pedestals 200, in accordance with another aspect of the invention, are not evenly spaced from each other. They are located on surface 50 in a random predetermined spatial relationship as schematically illustrated in FIG. 19. Since all pedestal spacings are different in the illustrated portion of surface 50, the resonant frequency FR1, FR2, FR3 . . . FRN are all different. Consequently, there is no resonant frequency which is predominant to cause undue ringing of the membrane. As can be seen graphically in FIG. 19, and with the dimensional characteristics set forth in FIG. 12, the area $A_O$ surrounding pedestal 200 is substantially greater than the area $A_P$ formed on the tops of pedestals 200. The relationship of these areas can be calculated by the dimensions shown in FIG. 12 wherein the spacing between each insulating piece 210 is approximately 0.015 inches, but which is varied slightly to produce minimized ringing effect illustrated in FIG. 18. The normal diameter of surface 50 is 1.25 inches; therefore, the pattern or array shown in FIG. 18 is repeated many times over the surface 50 of backplate 10. In practice, a preselected pattern is created using a given number of pedestals and this pattern or array is repeated throughout the extent of surface 50. Other arrangements could be employed for reducing ringing by causing different resonant frequencies at various areas between pedestals on surface 50.

As shown in FIG. 8A, the invention essentially increases $R_L$ to be substantially lower than the somewhat fixed bleeding rate represented as $R_F$. During each sample or pulse ST (FIGS. 4, 9A and 9B) voltage is accumulated on film 80. In the present invention the ultimate accumulated charge is low whereas in the prior art the charge continues and $V_P$ generally equals the applied bias. This can happen during a single pulse and require many minutes or longer to discharge if it can discharge. Consequently, prior art transducers of this type cannot be used successfully for continuous industrial applications. Leakage current is generally in the range of 1–5 nanoamperes after the first shock to the membrane and film 80 has a nominal thickness of about 0.0003 inches with a layer 82 of about 0.0001 inches.

The negative photoprocessing is explained; however, positive processing is the equivalent thereof.

Having thus defined the invention, the following is claimed:

1. In a capacitance type, electrostatic air pressure wave transducer, said transducer including: a relatively inflexible backplate with at least one major surface thereof formed of electrically conductive material, a relatively flexible membrane including a layer of electrically conductive material stretched across and coextensive with said one major surface; and means formed in said conductive material for maintaining a capacitor forming spacing between said major surface and said stretched membrane, the improvement comprising: said means for maintaining said spacing is a multitude of discrete metal pedestals distributed on said major surface with a generally flat top surface covered by an individual thinner piece of electrically insulating material.

2. The improvement as defined in claim 1 wherein said piece of insulating material has a first area and said tops of said pedestals have a second area and said first area being substantially larger than said second area whereby said insulating material extends outwardly from said pedestals.

3. The improvement as defined in claim 2 wherein each of said pedestals has substantially the same transverse cross-section.

4. The improvement as defined in claim 3 wherein said cross-section is generally circular.

5. The improvement as defined in claim 1 wherein a majority of said pedestals have a generally circular transverse cross-section.

6. The improvement as defined in claim 5 wherein said piece of insulating material has a first area and said tops of said pedestals have a second area and said first area being substantially larger than said second area whereby said insulating material extends outwardly from said pedestals.

7. The improvement as defined in claim 1 wherein said pedestals are arranged in a preselected array defined by top surfaces of said pedestals.

8. The improvement as defined in claim 7 wherein said array is created photographically.

9. The improvement as defined in claim 7 wherein said array includes preselected spacings between adjacent pedestals.

10. The improvement as defined in claim 9 wherein said spacings are varied to provide different resonant frequencies at different locations on said membrane.

11. The improvement as defined in claim 1 wherein said pedestals are arranged in a preselected array defined by top surfaces of said pedestals.

12. The improvement as defined in claim 11 wherein said array is created photographically.

13. The improvement as defined in claim 11 wherein said array includes preselected spacings between adjacent pedestals.

14. The improvement as defined in claim 13 wherein said spacings are varied to provide different resonant frequencies at different locations on said membrane.

15. In a capacitance type, electrostatic air pressure wave transducer, said transducer including: a relatively inflexible backplate with at least one major surface thereof formed of electrically conductive material; a relatively flexible membrane including a layer of electrically conductive material stretched across and coextensive with said one major surface; and means formed in said conductive material for maintaining a capacitor forming spacing between said major surface and said stretched membrane, the improvement comprising: said means for maintaining said spacing is a multitude of discrete metal pedestals formed by etching away said major surface except in photographically selected areas defining said pedestals and including a piece of electrically insulating material at each of said selected areas and on the top surface of each of said pedestals.

16. The improvement as defined in claim 15 wherein said thin piece of insulating material has a first area and said tops of said pedestals have a second area and said first area being substantially larger than said second area whereby said insulating material extends outwardly from said pedestals.

17. In a capacitance type, electrostatic air pressure wave transducer, said transducer including: a relatively inflexible backplate with at least one major surface thereof formed of electrically conductive material; a relatively flexible membrane including a layer of electrically conductive material stretched across and coextensive with said one major surface; and means formed in said conductive material for maintaining a capacitor forming spacing between said major surface and said stretched membrane, the improvement comprising: said means for maintaining said spacing is a multitude of discrete metal pedestals with preselected cross-sections and distributed over said surface in a preselected array, said array includes preselected spacings between adjacent pedestals and said spacings are varied to provide different resonant frequencies at different locations on said membrane and including a thin piece of electrically insulating material on the top surface of each of said pedestals.

18. The improvement as defined in claim 17 wherein said pedestals each have a top flat surface and including a piece of electrically insulating material on the top surface of each of said pedestals.

19. A method of producing a generally flat membrane supporting surface as an electrically conductive portion of a backplate of an electrostatic shock wave transducer for transmitting and/or receiving pressure energy waves, said method comprising the steps of:

(a) applying an electrically insulating, photoresist costing on said supporting surface;
(b) masking a multitude of preselected small discrete pedestal areas in a preselected array distributed over said supporting surface to define non-pedestal areas, said pedestal areas being separated by said non-pedestal areas;
(c) directing a sensitizing wave against said supporting surface to expose one of said areas of said support surface;
(d) photographically removing said photoresist coating from said non-pedestal areas whereby small pieces of said photoresist coating remain on said pedestal areas;
(e) spray etching said supporting surface with a solution reactive with only said supporting surface in said non-pedestal areas; and,
(f) continuing said spray etching until said small pieces each define a pedestal on said supporting surface.

20. A method of producing a generally flat membrane supporting surface as an electrically conductive portion of a backplate of an electrostatic pressure wave transducer, said method comprising the steps of:

(a) applying an electrically insulating, photoresist coating on said supporting surface;
(b) masking a multitude of preselected discrete pedestal areas in a preselected array distributed over said supporting surface to define non-pedestal areas, said pedestal areas being separated by said non-pedestal areas;
(c) directing a sensitizing wave against said supporting surface to expose one of said areas of said support surface;
(d) photographically removing said photoresist coating from said non-pedestal areas whereby pieces of said photoresist coating remain on said pedestal areas;
(e) spray etching said supporting surface with a solution reactive with only said supporting surface in said non-pedestal areas; and,
(f) continuing said spray etching until said small pieces each define a pedestal on said supporting surface.

21. A method of transmitting a pressure wave from a capacitance type, electrostatic transducer used for determining distance of an object and for receiving an echo of said pressure wave, said transducer including a relatively inflexible backplate with at least one major surface thereof formed of electrically conductive material, a relatively flexible membrane formed of an electrically insulating layer and an outer electrically conductive layer stretched over and coextensive with said major surface and cavities in said surface to define capacitance spacing between said conductive layer and conductive material, said method comprising the steps of:

(a) applying a known high voltage greater than 150 volts D.C. across said conductive layer and conductive material to create a sudden pressure wave;

(b) holding said known voltage across said layer and conductive material until said echo is received; and, (c) gradually removing said known voltage from across said layer and conductive material whereby a sudden pressure is not created.

22. A method as defined in claim 21 wherein said steps (a), (b) and (c) are repeated at a given rate.

23. A method as defined in claim 21 wherein said sudden pressure wave is a shock wave.

24. A method of producing a generally flat membrane supporting surface as an electrically conductive portion of a backplate of an electrostatic shock wave transducer, said method comprising the steps of:

(a) applying an electrically insulating, photoresist coating on said supporting surface;

(b) masking a multitude of preselected small discrete pedestal areas in a preselected array distributed over said supporting surface to define non-pedestal areas, said pedestal areas being separated by said non-pedestal areas;

(c) directing a sensitizing wave against said supporting surface to expose one of said areas of said supporting surface;

(d) photographically removing said photoresist coating from said non-pedestal areas whereby small pieces of said photoresist coating remain on said pedestal areas;

(e) spray etching said supporting surface with a solution reactive with only said supporting surface in said non-pedestal areas; and, (f) leaving said photoresist coating on said pedestal areas.

25. A method of producing a generally flat membrane supporting surface as an electrically conductive portion of a backplate of an electrostatic pressure wave transducer, said method comprising the steps of:

(a) applying an electrically insulating, photoresist coating on said supporting surface;

(b) masking a multitude of preselected discrete pedestal areas in a preselected array distributed over said supporting surface to define non-pedestal areas, said pedestal areas being separated by said non-pedestal areas;

(c) directing a sensitizing wave against said supporting surface to expose one of said areas of said supporting surface;

(d) photographically removing said photoresist coating from said non-pedestal areas whereby pieces of said photoresist coating remain on said pedestal areas;

(e) spray etching said supporting surface with a solution reactive with only said supporting surface; and, (f) leaving said photoresist coating on said pedestal areas.

26. A method of producing a generally flat membrane supporting surface as an electrically conducting portion of a backplate of an electrostatic pressure wave transducer, said transducer comprising said backplate and a relatively flexible membrane, said method comprising the steps of:

(a) applying an electrically insulating coating on said supporting surface;

(b) removing selected areas of said insulating coating and said supporting surface underlaying selected areas of said insulating coating to a preselected depth; and, (c) leaving said insulating coating on said supporting surface in remaining areas of said supporting surface whereby insulating coating topped support pedestals are provided.

27. The method of claim 26 wherein said removing step (b) includes undercutting whereby said insulating coating on said supporting surface remaining after said removing step overhangs said support pedestals.

28. The method of claim 26 wherein said insulating coating is a photosensitive coating and step (b) comprises:

(b1) masking said photosensitive coating on said supporting surface to establish pedestal areas and non-pedestal areas;

(b2) exposing said masked photosensitive coating;

(b3) removing said photosensitive coating from said non-pedestal areas; and, (b4) removing said supporting surface underlaying said non-pedestal areas to a preselected depth.

29. The method of claim 28 wherein said step (b4) comprises chemically etching said supporting surface.

30. The method of claim 29 wherein said etching is continued until said support pedestals comprise an insulating coating of a first area supported on a supporting surface pedestal of a second area smaller than said first area.

* * * * *